United States Patent [19]

Williams

[11] 4,397,503

[45] Aug. 9, 1983

[54] AURIFEROUS GRAVEL INTERCEPTOR

[76] Inventor: Harry K. Williams, 1204 Roxboro House, 330-26th Ave. S.W., Calgary, Alberta T2S 2T3, Canada

[21] Appl. No.: 272,087

[22] Filed: Jun. 10, 1981

[30] Foreign Application Priority Data

Jun. 17, 1980 [CA] Canada ..... 354147

[51] Int. Cl.[3] ..... E21C 45/00

[52] U.S. Cl. ..... 299/8; 209/44; 209/257; 210/159; 405/74

[58] Field of Search ..... 299/7–9; 405/74; 209/44, 250, 243, 257; 210/159, 162, 170

[56] References Cited

U.S. PATENT DOCUMENTS

| | | | |
|---|---|---|---|
| 553,775 | 1/1896 | Bronson | 299/9 |
| 3,013,395 | 12/1961 | Gaylord | 405/74 |
| 3,210,121 | 10/1965 | Struven | 299/8 |
| 3,754,789 | 8/1973 | Hering | 299/8 |

FOREIGN PATENT DOCUMENTS 719165 10/1965 Canada .

*Primary Examiner*—Ernest R. Purser
*Attorney, Agent, or Firm*—Bradford E. Kile

[57] ABSTRACT

A continuous belt traverses a river through channels on the river bed and carries intercepted material to the river banks for separation of precious metals and gemstones therefrom. Method and apparatus claimed.

6 Claims, 6 Drawing Figures

35
100
26
28
26
28
27
100
12
17
29
19
17
100
17
29
19
17
12
14
13
11

35
100
26
28
26
28
27
12
17
29
19
17
100
17
29
19
17
14
13
11

AURIFEROUS GRAVEL INTERCEPTOR

This invention relates to a method of intercepting gold and other precious metals and gemstones from river bed material and to apparatus for performing the same. More particularly, in one aspect this invention relates to screening river bed material carried by the flow of current across the river width, transporting material thus collected to the banks, and separating precious metals and gemstones from such river bed material. In another aspect, this invention relates to an apparatus placed on a river bed transversely to the flow and on the adjoining banks for screening river bed materials carried by the river current flow, transporting materials so screened to the banks, and separating precious metals and gemstones from the materials so transported.

In still another aspect, this invention relates to an apparatus placed on the bottom of a conventional hydraulic sluice box transversely to the flow for screening sluice box materials etc., transporting materials so screened away from the sluice box and separating precious metal and gemstones from the material so transported.

There are many rivers throughout the world where valuable metals flow with the river bed material. Among these are the Yukon, the Fraser and the Klondike in Canada, whose bars have yielded gold to the value of many millions since 1859. Some rivers in Africa and South America not only carry gold, but precious and semi-precious gemstones. Over the years the recoveries of gold have been primarily from river benches and bars, whereas the river and creek beds have not been exploited because of powerful currents and other problems. Draglines, barges, dredges and skin divers have been used with little success, yet the Fraser, for example, can be considered a sluice box through which immense values in gold and platinum are constantly flowing day and night.

The retrieval of precious metals from previously inaccessible locations has recently become economically viable due to surges in the value of such metals. Creeks and streams and other minor water flows have long been manually screened for precious metals dislodged from upstream surface deposits by erosion and carried by such flows. Moreover, only a small fraction of the material moving on the bed of such flows can be screened in this manner, and a comprehensive screening of the entire width of flow has seldom been attempted. Additionally, the high flow rates and uneven beds of large rivers have made their screening for precious metals almost impossible.

Attempts have at times been made to tunnel under rivers and connect such tunnels with the river bed by boreholes. However, such tunneling procedures are extremely expensive and also do not allow for deviations in the channel path or flow rate that may result in a decrease in precious metal movement past the boreholes. Also, precious metals may pass through borehole locations. Bed rock tunneling under creek beds in the Cariboo proved lucrative but fatal to the miners in many instances.

A system of magnetically extracting precious metals from river flow has been suggested. Under such a system, one part of a magnetized conveyor belt would operate transversely through the river flow while the other part, operating over the river, would sift material lifted by a nozzle from the river bed and deposited on it. Both parts of the belt would be continuously scraped for adhering magnetic ore. However, the effectiveness of such a system would be dependent on both a high percentage of the precious metal being bound to magnetic ore and on the proximity of such ore to either the magnetic belt or the river bed nozzle.

The subject invention, which collects a high percentage of the precious metal and gemstones flowing on a river bed past a given point, is easily installed, is adjustable to fit various bed widths, is portable and re-usable, and once installed, operates automatically. The invention creates a continuous trap across the river bed analogous to the riffles in a miner's sluice box. As an apparatus, the invention comprises a base with two upward-facing longitudinal channels, placed on the channel bed lateral to the direction of flow, with rollers mounted in each of said channels and, longitudinally in line with said channels, on both banks. It further comprises a continuous belt, passing over rollers in one of the said channels, over and around the rollers on one of said banks, over rollers in the other of said channels, and over and around the rollers on the other of said banks. Under the endmost of said rollers on both banks is placed a collection means, and one of said endmost rollers is powered to move the belt. Material carried on the river bed is screened by gratings mounted on a step across the top of the base. A means is located in each channel below the belt and rollers for flushing away material.

In a further embodiment, each of the rollers in the channels comprises a pair of rollers laterally spaced and mounted at an inwardly downward angle. In a still further embodiment, the apparatus also comprises a guide means between the grating and the belts. In yet another embodiment, the base is further comprised of a linkage of longitudinal sections of convenient size.

As a method, the invention comprises the steps of firstly, screening from a river at a position extending lateral to flow, material carried on the bed of the river; secondly, depositing the material on to a continuous belt; thirdly, transporting the material to the bank of the river; finally, separating precious metal and gemstones from the material.

The instant specifications set forth the best mode known to the inventor of carrying out the instant invention but it is pointed out that the specific instruction and method shown herein are for illustrative purposes and for purposes of example only. Various changes and modifications may obviously be made without departing from the spirit and scope of this invention.

The invention will now be fully described by reference to the accompanying drawings which are made a part of the specification.

Figure 1:
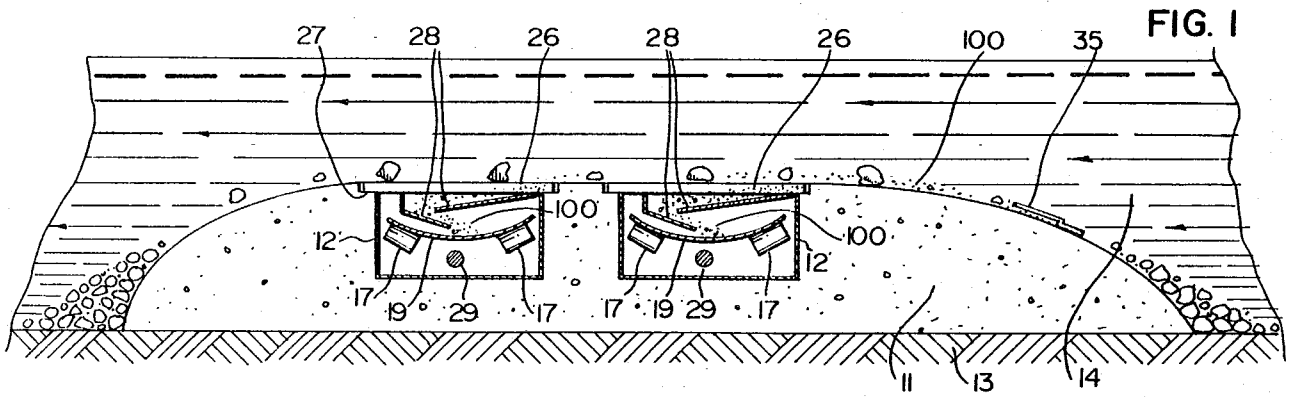
FIG. 1 is a cross-sectional view of that part of the apparatus that is placed laterally across the river bed.
Figure 2:
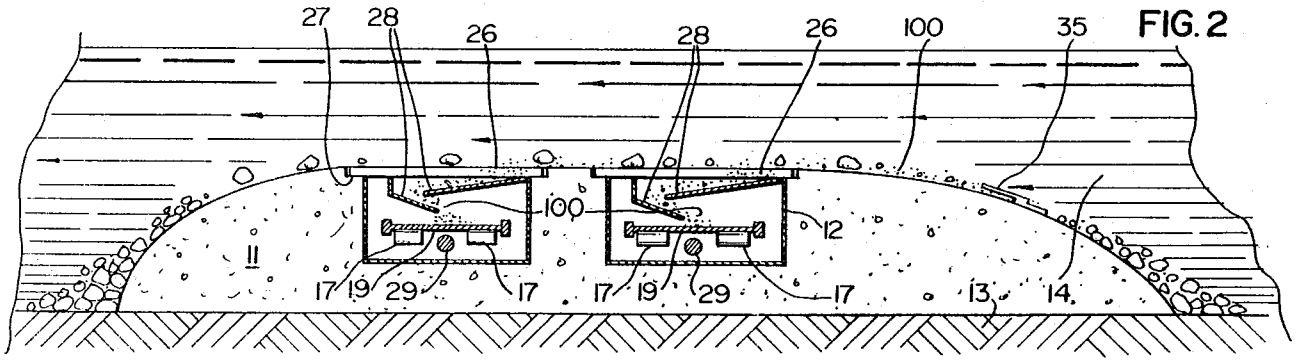
FIG. 2 is a similar cross-sectional view to FIG. 1 but illustrating a different belt and roller configuration.

Referring now to the form of the apparatus herein as set forth in the drawings a precast reinforced base 11 with dual parallel longitudinal channels 12 is placed on the bed 13 of a river 14, lateral to the direction of flow. For ease of installation and adaption to beds of various widths, this base is longitudinally segmented into convenient size parts which are linked by pinned connecting means 15. Shrouds 16 are placed on the base to cover the gaps resulting from the slight separation of adjoining longitudinal segments, so as to prevent the river current from affecting activity within the channels. A series of paired laterally spaced rollers 17 either sitting horizontally (as in FIG. 2) or sloping inwardly downward (as in FIG. 1) and pivoting on mounts 18, are located in each channel 12. A continuous belt 19 rides on the rollers 17 in one of the channels 12 and then on rollers 20 mounted on elevating trestles 21 on one of the river banks 22. As illustrated in FIG. 2, the belt if sitting or horizontal rollers, would have side shoulders. It then passes over and around the most elevated roller 23, powered by a motor 24, both of which are mounted on the most elevated trestle 25. Then, inverted, the belt 19 returns over rollers 20, then over rollers 17 in the other channel and is then similarily inverted by passing over and around the most elevated roller on the other bank. Covering each channel 12 is a grating 26 that sits on a step 27 in base 11. Collecting guides 28 are located under grates 26 and above belt 19. A perforated pipe 29 is centered under belt 19 and above the floor of each of the channels 12. On each bank 22 under roller 23 is located a sluice box 30 in which are located spaced riffles 31 and above which is a feed-in pipe 32.

In operation, material 100 including precious metals and gemstones carried by the flow 14 along the river bed 13 moves across the top of base 11 and, if smaller than a desired size, passes through the upstream grate 26 or failing that, through the downstream grate 26, onto the deflecting guides 28 and thence onto the belt 19. The material on the belt 19 is deposited on each bank into the top of sluice box 30 as the belt passes over and around roller 23. Water from pipe 32 flushes the material down sluice box 30 and over riffles 31, resulting in retrieval of the precious metals and gemstones. In each channel 12, water under high pressure is passed through perforated pipe 29 to periodically flush out any material that may have eluded belt 19 and jammed the free movement of the belts.

Figure 3:
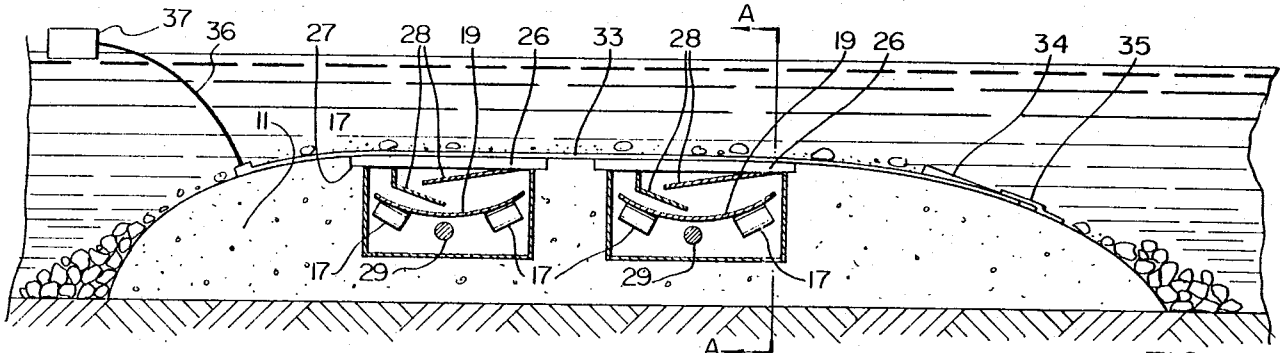
FIG. 3 is a similar cross-sectional view to FIG. 1 but additionally illustrating a covering means used during installation.
Figure 4:
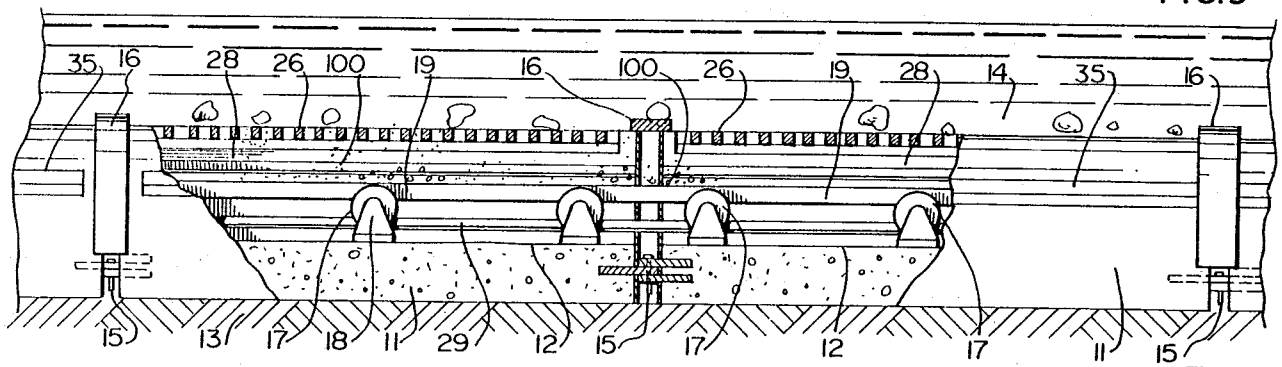
FIG. 4 is a longitudinal sectional view of that part of the apparatus that is placed laterally across the river bed.
Figure 5:
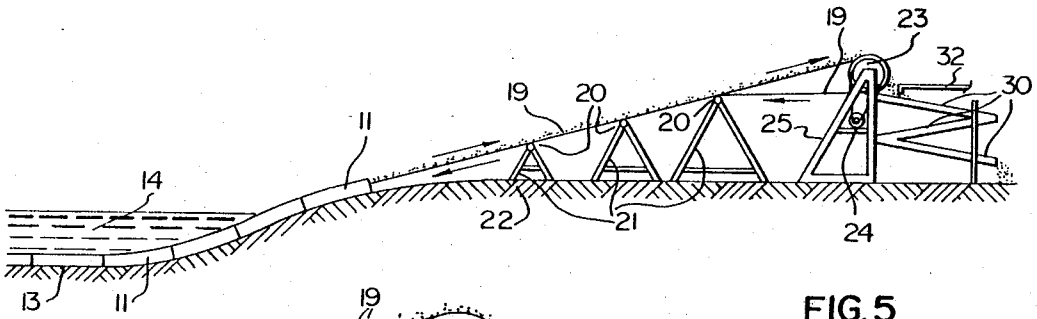
FIG. 5 is a side view of that part of the apparatus located on each river bank.
Figure 6:
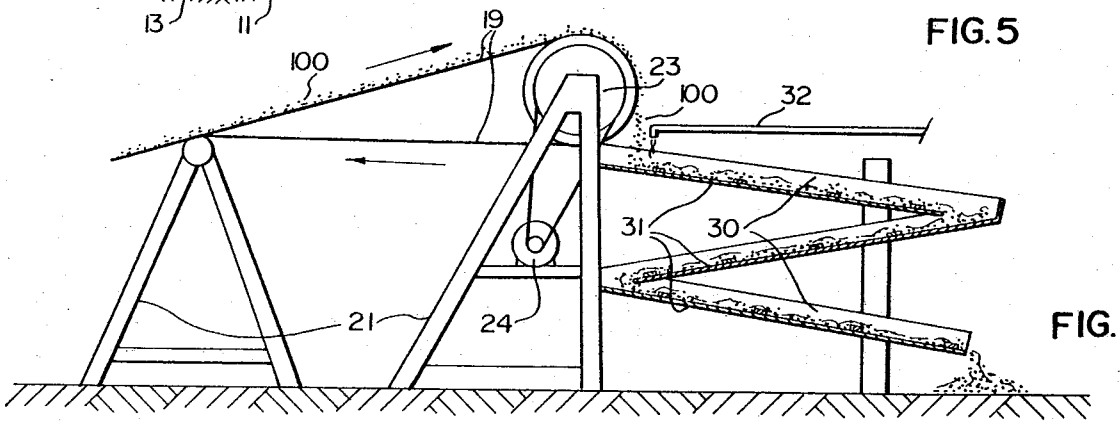
FIG. 6 is a detailed view of the collection means at each end of the apparatus.

During installation of the invention in a river, a canvas cover 33 is placed over the upper surface of the base 11, its upstream end secured between a clip 35, attached upstream of gratings 26, and a wedge 34, and its downstream end fastened to a rope 36 which is tensioned by attachment to float 37. FIG. 3 illustrates the positioning of these elements.

The embodiments of the invention in which an exclusive property or privilege is claimed are defined as follows:

1. An apparatus for collecting precious metal and gemstones from a river, comprising:

(a) a base with two upward-facing longitudinal channels, placed on the river bed lateral to the direction of flow;

(b) rollers mounted in each of said channels and on both banks, longitudinally in line with said channels;

(c) a continuous belt, passing over rollers in one of said channels, over and around the rollers on one of said banks, over rollers in the other of said channels, and over and around the rollers on the other of said banks;

(d) collection means under the endmost of said rollers on both banks;

(e) power means to move said belt;

(f) gratings affixed to said base across the top of said channels;

(g) flushing means for said channels below said rollers.

2. The apparatus of claim 1, wherein each of said rollers in each of said channels comprises a pair of rollers laterally spaced and mounted at an inwardly downward angle.

3. The apparatus of claims 1 or 2, and further comprising guide means between said grating and said belts.

4. The apparatus of claim 1 or 2, wherein said base comprises a linkage of longitudinal sections of convenient size.

5. A method of collecting precious metal and gemstones from a river, comprising the steps of:

(a) screening from said river, material moving along the bed of said river and containing said precious metal and gemstones, by positioning a channel member having a screened upper surface laterally across the bed of said river;

(b) collecting said screened material on a belt means moving longitudinally through said channel member, the belt means transporting the screened material to at least one bank of the river;

(c) removing said screened material from said belt means on said at least one bank of the river; and (d) separating said precious metal and gemstones from said screened material after removal of said screened material from said belt.

6. The method of claim 5, wherein the belt means is a continuous belt assembly the opposite end of which terminate on respective opposite banks of the river and wherein the belt of the continuous belt assembly presents one surface for collecting said screened material during passage of the belt through the channel in one direction and presents a second surface for collecting said screened material during passage of the belt through the channel in the opposite direction, the screened material being removed from the belt at both ends of the belt.

* * * * *